United States Patent [19]

Gersin et al.

[11] 4,152,803

[45] May 8, 1979

[54] AUTOMATIC DISPENSER-APPLICATOR

[75] Inventors: Robert P. Gersin, New York, N.Y.; Charles S. Totaro, Boonton, N.J.; Roland Gebhardt, New York, N.Y.; Modest Khovaylo, Old Bridge, N.J.

[73] Assignee: Colgate-Palmolive Company, New York, N.Y.

[21] Appl. No.: 815,021

[22] Filed: Jul. 12, 1977

[51] Int. Cl.[2] ..... A47L 13/46; B05C 17/00

[52] U.S. Cl. ..... 15/104.94; 15/231; 226/127; 226/151

[58] Field of Search ..... 15/104.94, 231, 233; 34/95.3; 51/359, 360; 226/127, 128, 151

[56] References Cited

U.S. PATENT DOCUMENTS

| | | | |
|---|---|---|---|
| 1,764,796 | 6/1930 | Kaiser | 34/95.4 |
| 2,166,508 | 7/1939 | Shipley et al. | 226/127 X |
| 4,112,536 | 9/1978 | Carson et al. | 15/104.94 |

*Primary Examiner*—Daniel Blum

*Attorney, Agent, or Firm*—Strauch, Nolan, Neale, Nies & Kurz

[57] ABSTRACT

An applicator device comprises two casing parts pivotally connected for movement between a longitudinally aligned closed position and a folded open position, one of said casing parts providing a tape supply chamber and the other providing a chamber for receiving and accumulating the tape after use. A flexible member anchored on the one casing part extends between the casing parts for forming a backing for the exposed material when the casing parts are relatively pivoted to said open position, and the flexible member at the same time acts to advance material out of the supply chamber and toward the other casing part. Unidirectional pawls in the other casing part are effective when the casing parts are relatively pivoted to closed position for preventing retraction of the tape.

7 Claims, 7 Drawing Figures

AUTOMATIC DISPENSER-APPLICATOR

This invention relates to applicator devices for more or less personal use wherein the applicator surface is automatically renewable as for successive treatments or applications.

More particularly the invention is concerned with an applicator device wherein manipulation of the device from a closed position to operative open position automatically advances a fresh section of a length or web of treated, impregnated or coated tape or tape-like material from a supply chamber to exposed condition over a firmed backing and automatically moves the previously used section of the material into a disposable chamber.

Dispensing devices are known wherein a web bearing a substance to be applied such as perfume may be incremently manually unwound from a supply reel through an applicator zone to be rewound on a take-up reel, but such devices do not effect automatic advance to the web for successive uses. Claff U.S. Pat. No. 3,441,353 is representative of such devices.

It is therefore a major feature of the present invention to provide a novel sectional dispenser-applicator device wherein a web or tape bearing a substance for treatment or other application is automatically incrementally advanced by manipulation of the device between closed and open operative positions.

A further feature of novelty is an applicator device wherein a length of impreganted, coated or otherwise treated material is stored in a supply chamber contained in one of two pivotally connected casing parts and this material is automatically advanced to place a fresh section thereof in exposed applicator position and to at the same time move and store a previously used section in a chamber in the other casing part by relatively moving the casing parts.

A further feature of novelty is that a flexible member, which may consist of a plurality of superimposed thin resilient synthetic plastic elements, extends from an end anchor in one casing part to dispose a free end in a pivotally connected casing part so that as the casing parts are relatively pivoted to expose a section of tape or the like bearing a substance to be applied said flexible member is projected to underlie and form a firm backing for the exposed section. Further this feature contemplates the provision of unidirectional tape feed means on said member and tape retaining means within said other casing part.

Further features of invention will become apparent as the description proceeds in connection with the appended claims and the annexed drawings.

PREFERRED EMBODIMENTS

Figure 1:
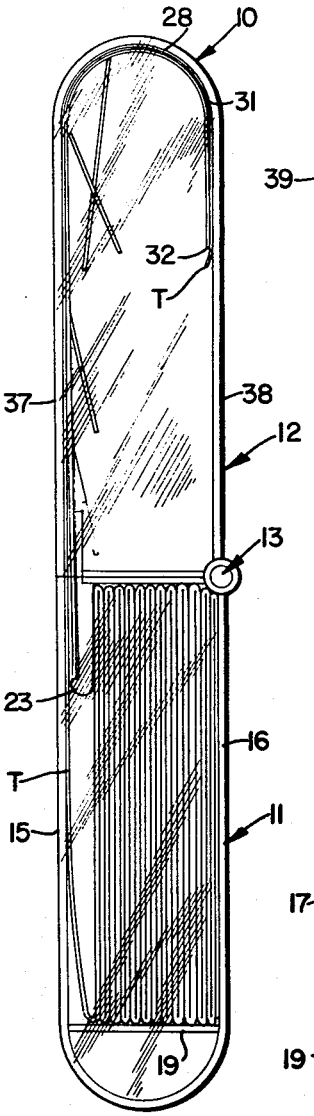
FIG. 1 is a side elevation showing the applicator in closed condition.
Figure 2:
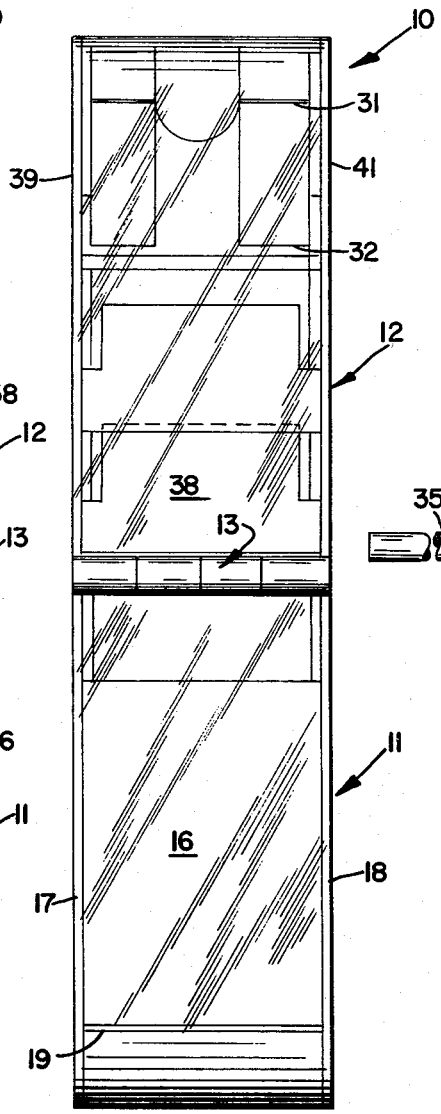
FIG. 2 is a rear view of the applicator of FIG. 1.
Figure 4:
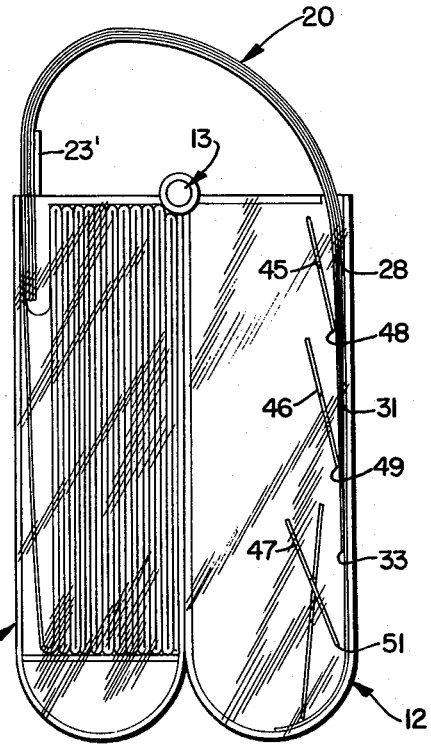
FIG. 4 is a side elevation showing the applicator as it is opened for dispensing and application.
Figure 5:
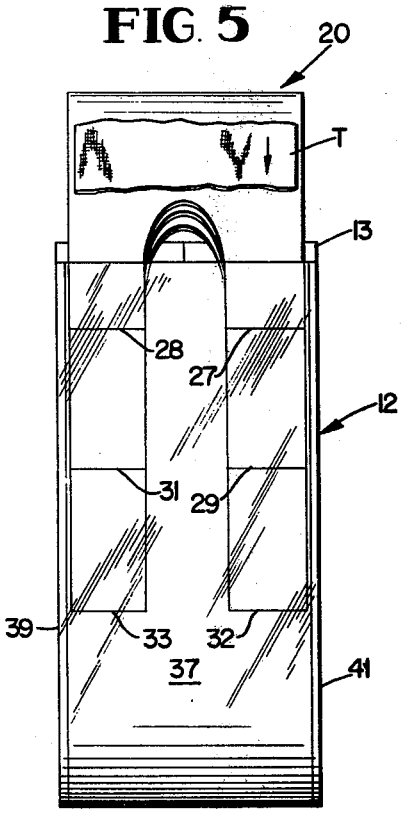
FIG. 5 is a rear elevation showing the disposition of the free end of the backing forming member in the used tape accummulation chamber.
Figure 7:
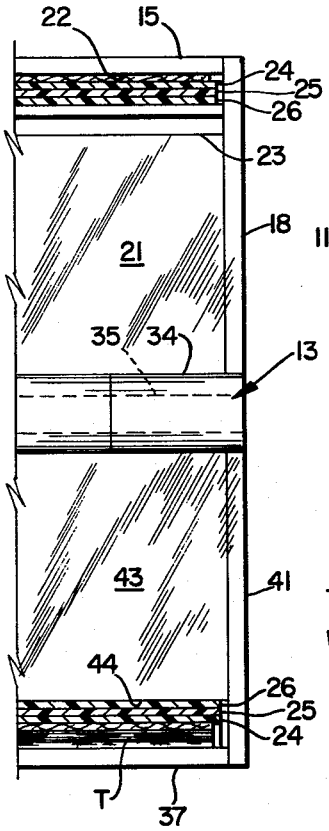
FIG. 7 is an enlarged fragmentary section substantially on line 7—7 of FIG. 6 showing detail.

The invention in its most preferred embodiment comprises a cassette 10 consisting of two substantially identical casing parts 11 and 12 pivotally interconnected by a hinge 13 enabling the cassette to be easily transformed from the closed position of FIG. 1 to the open operative position of FIG. 4.

Figure 6:
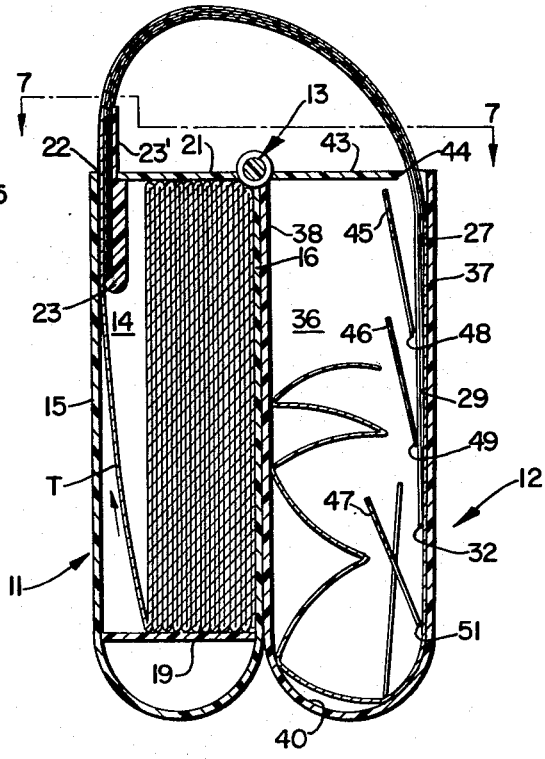
FIG. 6 is a side elevation like FIG. 4 but mainly in section and showing the manner of advance of the tape as the applicator is used.

Casing part 11 defines a tape supply chamber indicated at 14 in FIG. 6 wherein the tape T to be dispensed is stored in pleated or folded condition as shown. Casing 11 comprises a front wall 15, a parallel rear wall 16 and parallel side walls 17 and 18. An internal lower wall 19 and a top wall 21 coact with the other walls to define a chamber 14 that is closed except for a slot-like opening 22 along the front edge of wall 21 at the juncture of wall 21 and front wall 15. As will appear this opening 22 constitutes the tape dispensing outlet from chamber 14.

Referring to FIG. 1 and FIG. 6, an internal pawl anchoring base 23 is formed rigidly with wall 21 along the rear edge of slot 22 and fixed in base 23 are the overlapping ends of a flexible member 20 consisting of three superimposed thin blade-like synthetic plastic elements 24, 25 and 26. As shown these blade-like elements are of progressively increasing length, the shorter element 24 being the outermost and its outer smooth surface effectively defining the rear edge of slot 22.

Figure 3:
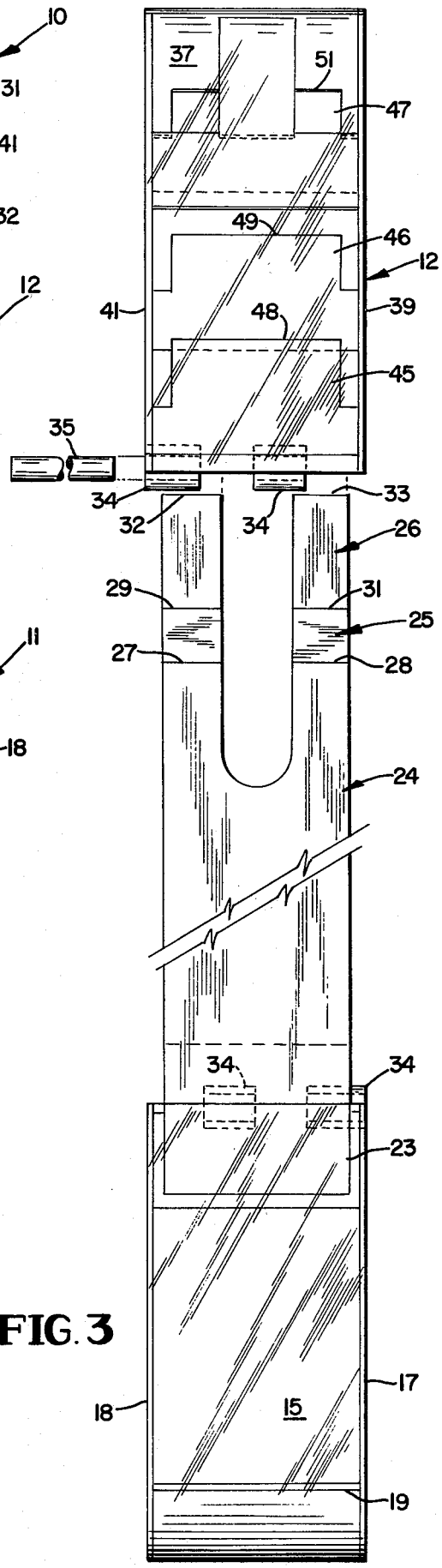
FIG. 3 is an exploded view showing detail structure.

Also, referring to FIG. 3, the free terminal ends of the blade-like elements are cut to be U-shaped whereby to increase flexibility at the ends and provide parallel tape engaging pawls having edges 27 and 28 on element 24, 29 and 31 on element 25, and 32 and 33 on element 26.

Elements 24, 25 and 26 are preferably of the same width, at least equal to the width of tape T, and are integral elements of thin smooth slippery synthetic plastic so that while stiff longitudinally and laterally they readily flex in their planes and slide relatively during operation as will appear.

Aligned tubular hinge formations 34 are fixed to the juncture between walls 16 and 21, and a hinge pin 35 extends through them.

Casing part 12 defines a used tape reception and accummulation chamber indicated at 36 in FIG. 6. Casing part 12 comprises a front wall 37, a parallel rear wall 38 and parallel side walls 39 and 41. A bottom wall 42 and a top wall 43 coact with other walls to define the chamber 36 which is closed except for a transverse slot 44 in wall 43 along the juncture between walls 43 and 38.

Slot 44 is long enough to ensure passage of the free ends of elements 24–26 and tape T, and is wide enough to permit sliding passage of the pawls and the superposed tape in operation as will appear. it is also wide enough in the cassette closed position to accept a short projection 23' upstanding at the anchored base 23 of the flexible member.

A plurality of tape retaining pawl elements are provided in casing part 12. These pawl elements may take the form of thin synthetic plastic pawl elements 45, 46, 47 fixed at their base portions to side walls 39 and 41 and terminating in reduced size free ends having parallel tape engaging edges 48, 49 and 51 respectively as shown in FIGS. 4 and 6.

As shown in FIGS. 1, 4 and 6 the retaining pawl elements extend angularly relative to wall 37 in such direction as to dispose their parallel edges 48, 49, 51 adjacent wall 37 with at least sufficient spacing to allow passage of the tape. Pawl elements 45–47 are thus so inclined as to define acute angles to wall 37 and the path of tape advance, so that they readily allow the tape to slide into chamber 36, but prevent retractive movment of tape T in the opposite direction. They are flexible.

All walls of the illustrated cassette are shown transparent for illustration of parts therewithin, but it will be understood that this is not essential.

OPERATION

As shown in FIG. 1 the closed cassette has a supply of tape bearing the substance to be applied stored in folded condition in chamber 14 of casing part 11. The two casing parts are in longitudinal end to end alignment with the free end of flexible member 20 projecting through aligned slots 22 and 44, along the inner surface of casing wall 37, around the smoothly curved inner surface 40 of the end wall of casing part 12 and partially down the inner surface of casing wall 38. Due to the resiliency of elements 24≧26 flexible member 20 tends to bias toward said inner wall surfaces.

It is preferable to initially thread the leading end of tape T through slots 22 and 44 and along the surface of flexible member 20 between member 20 snd the internal casing walls at least to a point past pawl edges 27, 28 where the tape will be effectively clamped between the end of pawl element 24 and the casing.

The width of slot 22 is made as small as operatively possible as to protect the contents of chamber 14 against evaporation of the substance on the tape, and actually the initial leading length of tape that extends into casing part 12 in FIG. 1 may be merely a leader strip and could be roughened or similaraly formed where it is clamped by pawl edges 27, 28 to ensure good friction action as will appear.

A suitable latch (not shown) may be used to maintain the casing parts in the end to end closed cassette position of FIG. 1, and in this condition the cassette will be delievered to the eventual user.

The user removes the latch and relatively pivots the casing parts about hinge 13 until casing walls 16 and 38 are in flush contact as shown in FIGS. 4 and 6, casing part 13 being rocked 180° clockwise from the position of FIG. 1. As casing part 12 rocks flexible member 20 remains anchored at one end at 23 while the inner surfce of casing wall 37 slides along the flexible member. The length of flexible member 20 is such that in the fully open position of FIG. 4 the free ends of all of the elements 24–27 remain within casing part 12 resiliently biased toward casing wall 37.

This action forms the intermediate portion of flexible element 20 into a bowed arcuate shape as shown, effectively projecting from the ends of the casing parts. The leading tape end which extends around the outer surface of this arcuate formation is pulled therealong out of the supply chamber because it is gripped by the advancing pawl edge or edges to the free end of flexible member 20.

Thus at the same time, the tape is automatically advanced to expose a fresh section and a firm arcuate backing for the exposed tape section is automatically provided. If the increment of advance is not enough to expose a sufficiently large fresh area of tape, and in any event when it is desired to next advance the tape, the casing parts are relatively rocked back to the FIG. 1 position.

As the casing part 12 rocks counterclockwise in FIGS. 4 and 6, within casing part 12 the tape will remain relatively stationary resiliently pressed against wall 37 due to the pawl action and the inner wall surface of casing part 12 and the flexible member 20 will slide relative to the tape. Thus the tape end is remained in casing part 12 while the casing parts and flexible member 20 move to closed position.

Now the opening operation may be repeated, thus drawing another section of tape out of the supply chamber in relatively snug engagement with the formed arcuate backing member provided by bowed member 20.

As diagrammatically shown in FIG. 6, the used section of tape will progressively accummulate in chamber 36 which has at least the volumetric capacity of chamber 14. During actual use of the device the foled casing parts serve as a handle for pushing the exposed tape section against the skin.

Since the outer end of flexible member 20 is free to slide at all times, this is peculiarly advantageous during actual use of the device since it may change slope in response to pressure and resiliently restore itself to beginning shape as the pressure eases.

Once all of the tape has been used and advanced into chamber 36, the entire cassette may be thrown away. Thus from beginning to end there is reduced danger of accidental contact of the substance to be applied with clothing or the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, amd all changes which come within the meaning and range of equivalency of the claims are therefore intended to be embraced therein.

What is claimed and desired to be secured by Letters Patent is:

1. An applicator device having an automatically renewable applicator surface comprising two casing parts pivotally connected for movment between a closed position and an open position wherein a surface impregnated with or otherwise bearing a treatment substance is exposed, one of said casing parts providing a supply chamber for storing a length of flexible tape or tape-like material bearing said substance and the other of said casing parts providing a chamber for receiving and accummulating said material after use, means for automatically feeding a fresh section of said material out of said first casing part to be exposed for use when the casing parts are relatively pivoted to open position comprising means extending between said casing parts automatically shaped for forming an arcuate backing surface for said exposed material when the casing parts are relatively pivoted to said open position, and comprising means whereby material at the leading end of said fresh section is positively advanced within said other casing part when said casing parts are relatively pivoted to open position, whereby a fresh section of material is advanced out of said one casing part of overlie said backing surface each time the casing parts are relatively pivoted to open position, and means in said other casing part effective when the casing parts are relatively pivoted back to closed position for preventing retraction of the material that has been advanced thereinto.

2. The applicator device defined in claim 1, wherein said means extending between the casing parts is a flexible member having one end anchored in said one casing part and the other end freely slidable in said other casing part and said member is deformed to provide said arcuate backing for the exposed section of tape.

3. The applicator device defined in claim 2, wherein said means for advancing the tape out of said supply chamber comprises unidirectional pawl means on said flexible member.

4. The applicator device defined in claim 2, wherein said flexible member comprises a laminate of thin relatively smooth separate synthetic plastic elements of different length having tape advancing pawls at their free ends.

5. The applicator device defined in claim 4 wherein one end of said member is fixed in said one casing part and the other different element length thereof extends freely within said other casing part.

6. The applicator device defined in claim 1, wherein said means for preventing retraction of the tape from said other casing portion comprises unidirectional tape engaging pawl means within said other casing part.

7. The applicator device defined in claim 2, wherein said casing parts are longitudinally aligned in closed position with two end walls adjacent and are folded through about 180° to open position, and said flexible member projects through apertures in said two end walls in all relative positions of said casing parts.

* * * * *

UNITED STATES PATENT OFFICE

CERTIFICATE OF CORRECTION

Patent No. 4,152,803 Dated May 8, 1979

Inventor(s) Robert Peter Gersin et al.

It is certified that error appears in the above-identified patent and that said Letters Patent are hereby corrected as shown below:

Column 1, line 40, change "superimposed" to --superposed--.
Column 2, line 25, change "superimposed" to --superposed--.
Column 2, line 54, change "it" to --It--.
Column 3, line 20, change "24≧26" to --24-26--.
Column 3, line 24, change "snd" to --and--.
Column 3, line 33, change "similaraly" to --similarly--.
Column 3, line 39, change "delievered" to --delivered--.
Column 3, line 43, change "13" to --12--.
Column 3, line 45, change "surfce" to --surface--.
Column 4, line 4, change "remained" to --retained--.
Column 4, line 14, change "foled" to --folded--.
Column 4, line 33, change "amd" to --and--.
Claim 1, column 4, line 59, change "of" second occurrence to --to--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*